US005144384A

United States Patent [19]

Fujita et al.

[11] Patent Number: 5,144,384

[45] Date of Patent: Sep. 1, 1992

[54] AUTOMATIC SHEET FEEDER HAVING MEANS FOR RESUMING CONTINUOUS COPYING AFTER POWER STOPPAGE

[75] Inventors: Hiroyuki Fujita, Sakai; Kazushi Takimoto, Kadoma; Keiichi Taguchi, Kyoto, all of Japan

[73] Assignee: Mita Industrial Co., Ltd., Japan

[21] Appl. No.: 634,490

[22] Filed: Dec. 27, 1990

[30] Foreign Application Priority Data

Dec. 29, 1989 [JP] Japan ..... 1-341111

[51] Int. Cl.[5] ..... G03G 21/00

[52] U.S. Cl. ..... 355/308; 355/203; 355/204; 355/207; 355/321

[58] Field of Search ..... 355/203–207, 355/308, 316, 317, 320, 321, 209; 271/3, 3.1, 259, 265

[56] References Cited

U.S. PATENT DOCUMENTS

| | | | |
|---|---|---|---|
| 4,248,526 | 2/1981 | Shunichi et al. | 355/205 |
| 4,260,904 | 4/1981 | Horie et al. | 355/206 X |
| 4,521,847 | 6/1985 | Ziehm et al. | 355/206 X |
| 4,791,453 | 12/1988 | Koseki et al. | 355/209 |
| 4,881,101 | 11/1989 | Sumida | 355/204 |
| 4,954,848 | 9/1990 | Arima | 355/204 X |

*Primary Examiner*—A. T. Grimley

*Assistant Examiner*—William J. Royer

*Attorney, Agent, or Firm*—Beveridge, DeGrandi & Weilacher

[57] ABSTRACT

An automatic sheet feeder for a copying machine etc. for correctly resuming a continuous copying operation after power to the sheet feeder (as well as the copying machine) is stopped by an emergency (safety) power stop. The copying machine has a state memory in which the state of the automatic sheet feeder (whether it is operating or not operating) at the time of a power stoppage to the automatic sheet feeder is stored. When the supply of power to the automatic sheet feeder begins, the state data is sent from the copying machine to the automatic short feeder. When the state data from the copying machine indicates that the sheet feeder was not operating, the automatic sheet feeder performs a preset initializing process in which the feeding rollers are rotated to eject the original sheet on the contact glass plate of the copying machine. When the state data indicates that the sheet feeder was operating when the power supply was stopped however the sheet feeder does not perform the initializing process and the original sheet still on the contact glass plate (which has not yet copied due to the emergency stop) is copied, and the continuous copying operation is resumed without missing any copies of plural original sheets.

2 Claims, 4 Drawing Sheets

AUTOMATIC SHEET FEEDER HAVING MEANS FOR RESUMING CONTINUOUS COPYING AFTER POWER STOPPAGE

BACKGROUND OF THE INVENTION

The present invention relates to an automatic sheet feeder mainly used for feeding an original sheet to a contact glass plate of an image reading machine (such as a copying machine).

When a stack of original sheets is placed on an initial tray of an automatic sheet feeder and a copying operation starts, an original sheet is taken out from the stack and the sheet is brought into a preset position on the contact glass plate of the copying machine on which the automatic sheet feeder is equipped.

The inside mechanism of the automatic sheet feeder is as follows. The uppermost (or sometimes the lowermost) sheet of the stacked original sheets is taken into the housing of the automatic sheet feeder by a taking-in roller (or rollers) and first placed at a preset adjusting site provided inside the automatic sheet feeder in order to determine the position of the original sheet (first feeding). Then the position-determined original sheet is transferred to the preset copying position of the contact glass plate by resist rollers (second feeding). Here, at the same time, the next original sheet undergoes the first feeding and is placed at the adjusting site.

After the image reading (copying operation) of the original sheet is finished, the original sheet is taken out from the contact glass plate and ejected onto a finished tray of the automatic sheet feeder by an ejecting mechanism. At the same time, the second original sheet is next fed to the preset copying position. Thus a continuous copying of a plurality of original sheets is automatically performed.

The automatic sheet feeder attached on the copying machine is electrically connected to the copying machine, and the timing of the above sheet feeding operations is controlled by command signals from the copying machine and the power is also given from the copying machine.

When the operator opens a cover of the housing of the copying machine in order to, for example, eliminate a jammed sheet, the power to the main parts of the copying machine is automatically cut for safety. In this case also the power to the automatic sheet feeder is cut. The problem is that the data in the volatile memory of the control system of the automatic sheet feeder is lost when the power to the automatic sheet feeder is cut. Among the data lost are data about the condition of the automatic sheet feeder and the position of the original sheet taken inside of the automatic sheet feeder. Therefore, when a continuous copying operation is interrupted by an opening of the cover (by a jamming trouble, for example), the automatic sheet feeder cannot resume the continuous copying operation correctly after the cover is closed again. In concrete, the trouble is that the original sheet on the contact glass plate at the time of jamming trouble during a continuous copying operation can never be copied: when the jammed paper is eliminated and the copying operation is restarted, the original sheet (which has not been copied) is ejected from the contact glass plate because the automatic sheet feeder executes a preset initializing routine. Thus the original sheet must be reset on the initial tray to correctly resume the continuous copying operation.

SUMMARY OF THE INVENTION

One of the objects of the present invention is to provide an automatic sheet feeder that can correctly resume a continuous copying operation after it is interrupted.

Another object of the present invention is to provide an automatic image reading system including an image reader (for reading an image of a sheet placed at a preset reading site) and a sheet feeder (for automatically feeding a sheet to the reading site of the image reader) where the sheet is assuredly read even after the reading process is interrupted.

The automatic image reading system according to the present invention comprises:

a power supply unit provided in the image reader for supplying power to the sheet feeder;

a power switch provided in the image reader for stopping the power supply to the sheet feeder;

a state memory provided in the image reader for storing a state data indicating that the sheet feeder is operating when the power supply to the sheet feeder is stopped;

first resuming means provided in the image reader for sending the state data when the power to the sheet feeder is resumed; and initializing means provided in the sheet feeder for initializing the sheet feeder when the power supply to the sheet feeder is started; and second resuming means provided in the sheet feeder for abolishing the initializing operation of the initializing means when the power supply to the sheet feeder is started and the state data comes from the image reader.

Other features of the present invention are described in the detailed description of the preferred embodiment that follows.

BRIEF DESCRIPTION OF THE ATTACHED DRAWINGS

DETAILED DESCRIPTION OF THE PREFERRED EMBODIMENT

Figure 2:
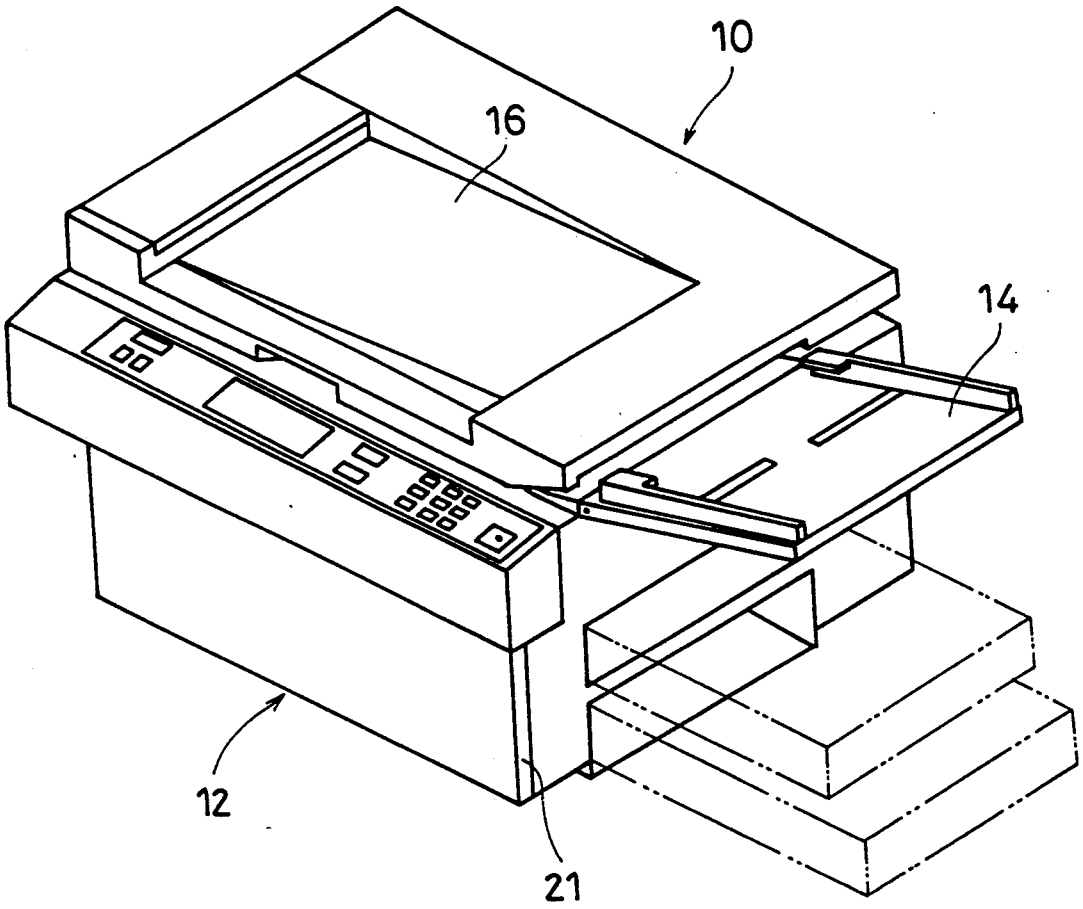
FIG. 2 is a perspective view of the copying machine with the automatic sheet feeder.

An automatic sheet feeder according to the present invention is attached to a copying machine as shown in FIG. 2. The automatic sheet feeder 10 is placed on a contact glass plate (not shown) at the top of the copying machine 12. The automatic sheet feeder 10 takes in an original sheet from a stack of sheets placed on an initial tray 14 and places the original sheet on an appropriate position of the contact glass plate. After a copying cycle of the original sheet is performed by the copying machine 12, the original sheet is ejected to a finish tray 16 at the top of the automatic sheet feeder 10. A maintenance cover 21 is provided in front of the housing of the copying machine 12. When a sheet jamming occurs in the copying machine 12, the operator can open the maintenance cover 21 to eliminate the jammed sheet.

Figure 3:
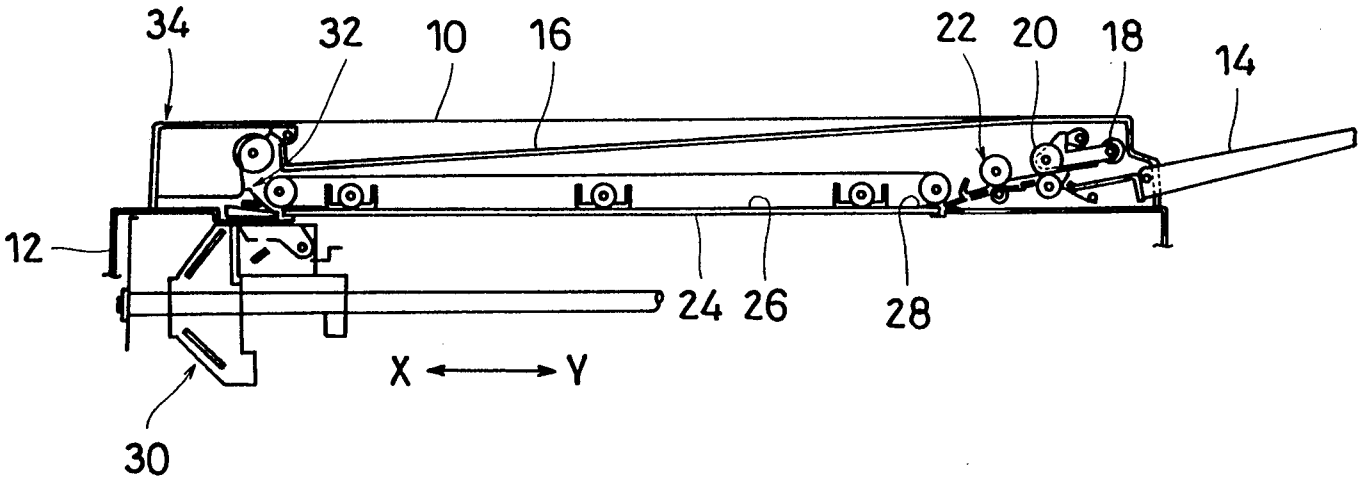
FIG. 3 is a longitudinal cross-sectional view of the automatic sheet feeder.

The inside of the automatic sheet feeder 10 is detailed in FIG. 3. The uppermost sheet on the initial tray 14 is introduce into the housing 34 of the automatic sheet feeder 10 by a swing roller 18, and fed to a preset adjusting site by first feed rollers 20 where the leading edge of the original sheet is stopped by a pair of resist rollers 22 (first feeding). Then, when a proper timing signal comes from the copying machine 12, the resist rollers 22 begin to rotate to insert the original sheet in a gap between the contact glass plate 24 and a conveyer belt 26, and the conveyer belt 26 brings the original sheet to an appropriate copying site on the contact glass plate 24 (second feeding).

After an optical system 30 of the copying machine 12 scans through the original sheet (in the direction X-Y), a proper timing signal is sent from the copying machine 12 to the automatic sheet feeder 10. Responding to the timing signal, the conveyer belt 26 passes the original sheet on the copying site to an ejecting mechanism 32 provided on the other side of the automatic sheet feeder 10, which ejects the original sheet onto the finish tray 16. At this same time, the next original sheet that has been waiting at the adjusting site is conveyed to the copying site (i.e., second fed) by the conveyer belt 26, and, immediately after that, the second next original sheet on the initial tray 14 is brought to the adjusting site (i.e., first fed).

Figure 1:
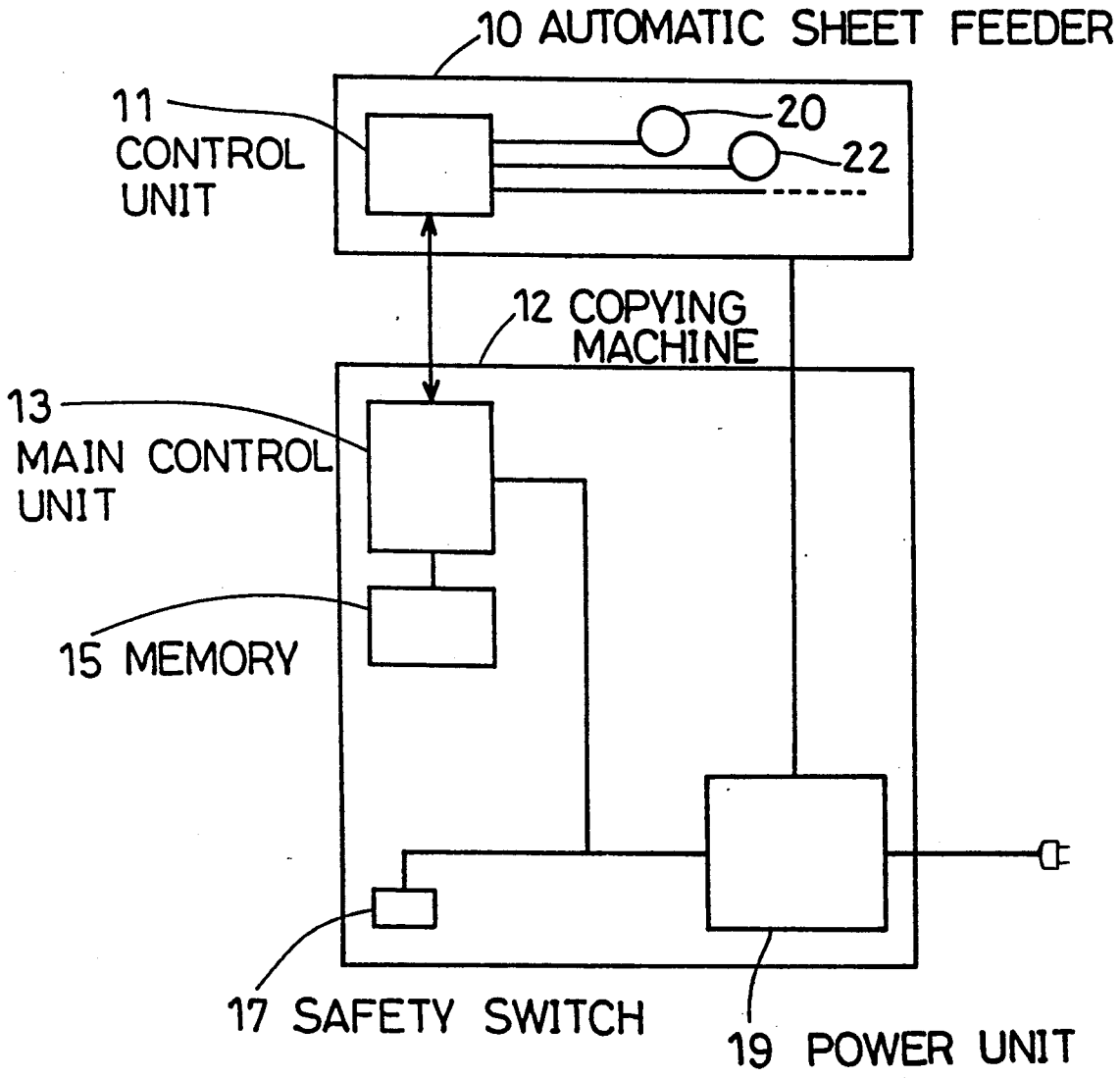
FIG. 1 is a block diagram of a copying machine equipped with an automatic sheet feeder embodying the present invention.

The electrical system of the copying machine 12 equipped with the automatic sheet feeder 10 is illustrated in FIG. 1. A main control unit 13 provided in the housing of the copying machine 12 controls various operations of the copying machine 12, and transmits control commands and data between the automatic sheet feeder 10. Among the data transmitted between them are included a timing signal for the sheet handling in the automatic sheet feeder 10. A memory 15 is connected to the main control unit 13 for storing data concerning the various operations of the copying machine 12 and the data representing the state of the automatic sheet feeder 10 at the time of interruption, which will be detailed later. A safety switch 17 is provided at the maintenance cover 21 which is normally on while the cover 21 is closed but turns off when it is opened. The safety switch 17 is also connected to the main control unit 13. The automatic sheet feeder 10 also has a control unit 11 for controlling the first feed rollers 20, resist rollers 22, etc. which, as described above, transmits data between the main control unit 13 of the copying machine 12. Among data sent from the control unit 11 of the automatic sheet feeder 10 to the main control unit 13 of the copying machine 12 is included state data indicating whether the automatic sheet feeder 10 is currently operative.

A sole power unit 19 is provided within the housing of the copying machine 12 which gives power to the automatic sheet feeder 10 as well as the copying machine 12. When the maintenance cover 21 is opened and the safety switch 17 turns off, the power unit 19 stops supplying power to the copying machine 12 and to the automatic sheet feeder 10.

Figure 4A:
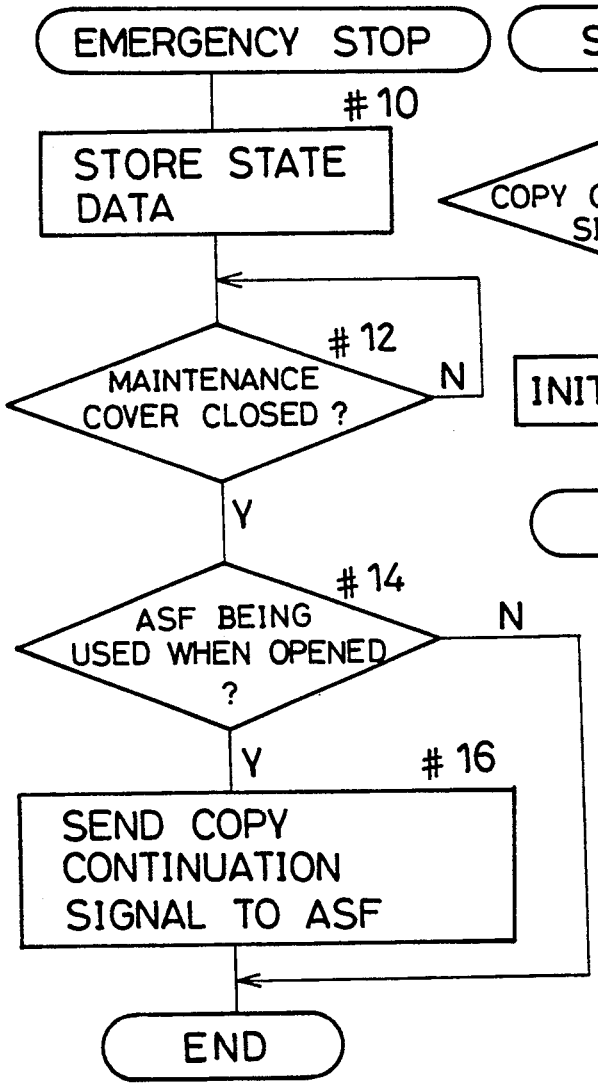
FIGS. 4A and 4B are flowcharts of the operations done by the main controller of the copying machine and the controller of the automatic sheet feeder, respectively.

The main control unit 13 of the copying machine 12 executes an emergency process as shown in FIG. 4A when the safety switch 17 is turned off. First at step #10, the main control unit 13 stores the state data (which indicates that the automatic sheet feeder 10 is currently operative or non-operative) sent from the control unit 11 of the automatic sheet feeder 10 to the memory 15. Then the process waits at step #12 until the cover 21 is closed (i.e., until the safety switch 17 turns on). When the maintenance cover 21 is closed, the process proceeds to step #14 where it is determined whether the automatic sheet feeder 10 had been operating at the time when the cover 21 was opened judging from the state data stored in the memory 15. If it is determined that the automatic sheet feeder 10 had been operating when the cover 21 was opened, the main control unit 13 sends a copy continuation signal to the control unit 11 of the automatic sheet feeder 10 at step #15 and resumes the copying operation that has been interrupted by the emergency stop (due to the opening of the cover 21). When the state data indicates that the automatic sheet feeder 10 had not been operating at the emergency stop, the step #16 is skipped. That is the emergency process executed by the main control unit 13.

Figure 4B:
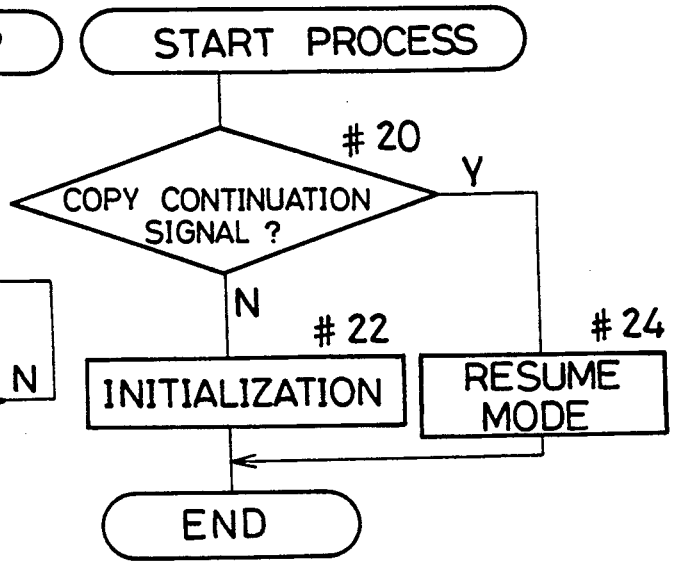

The control unit 11 of the automatic sheet feeder 10 executes a starting process as shown in FIG. 4B when the power begins to be supplied to the automatic sheet feeder 10 (which includes the case where the power is supplied again after emergency stopped). At first, the control unit 11 checks whether the copy continuation signal comes from the copying machine 12 at step #20. When no such signal comes, a predetermined normal initializing process is executed at step #22. In the normal initializing process, the first feed rollers 20, resist rollers 22, etc. are rotated until they come to a predetermined initial position. When it is determined at step #20 that the copy continuation signal comes from the main control unit 13 of the copying machine 12, the normal initializing process (step #22) is not executed but a resuming process is executed at step #24. Since the initializing action of the rollers is not performed in this case, the original sheet on the copying site is not ejected but stays there. Thus, when the copying operation is restarted at the copying machine 12 after it is stopped by the opening of the maintenance cover 21, the original sheet on the contact glass plate that was failed to be copied before is correctly copied, and the continuous copying operation resumes without missing any copy of the plural original sheets.

Though the invention is explained in detail with a specific embodiment in a copying machine system, it is a matter of course that the present invention is applicable to a general image reading machine such as an optical disk image recorder or a magneto-optical disk image recorder.

What is claimed is:

1. A system including an image reader for reading an image of a sheet placed at a preset reading site and a sheet feeder for automatically feeding a sheet to the reading site of the image reader, the system comprising:

a power supply unit provided in the image reader for supplying power to the sheet feeder;

a power switch provided in the image reader for stopping the supply of power to the sheet feeder from the power supply;

a state memory provided in the image reader for storing state data indicating whether the sheet feeder had been operating at a time when the supply of power to the sheet feeder was stopped;

first resuming means provided in the image reader for sending state data after the supply of power to the sheet feeder is resumed; and initializing means provided in the sheet feeder for initializing the sheet feeder when the supply of power to the sheet feeder is started, whereby a sheet on the reading site is ejected; and second resuming means provided in the sheet feeder for averting initializing by the initializing means when the power supply to the sheet feeder is started and state data from the image reader indicates that the sheet feeder had been operating at the time the supply of power to the sheet feeder was stopped.

2. A system as claimed in claim 1, where the image reader is a copying machine, and the power switch is a safety switch which stops the supply of power to the sheet feeder when a maintenance cover of the copying machine is opened.

* * * * *